United States Patent [19]

Turner

[11] 4,205,441

[45] Jun. 3, 1980

[54] RAZOR

[76] Inventor: George L. Turner, 4026 Gull Lane Dr. East, Hickory Corners, Mich. 49060

[21] Appl. No.: 3,665

[22] Filed: Jan. 15, 1979

[51] Int. Cl.[2] ..... B26B 19/44
[52] U.S. Cl. ..... 30/41.5
[58] Field of Search ..... 30/123.3, 41, 41.5, 30/41.6

[56] References Cited

U.S. PATENT DOCUMENTS

| | | | |
|---|---|---|---|
| 2,336,806 | 12/1943 | Schenk | 30/41 |
| 4,031,618 | 6/1977 | Mansfield | 30/41.5 |

*Primary Examiner*—Jimmy C. Peters
*Attorney, Agent, or Firm*—Fisher, Gerhardt, Crampton & Groh

[57] ABSTRACT

A razor for wet shaving which is connected to an aspirating device wherein running water creates a suction adjacent the cutting edge of a razor blade for instant removal and transport of severed beard and lather to the stream of running water and also to pull the shaver's skin into tighter conformity with the head of the razor.

9 Claims, 2 Drawing Figures

RAZOR

This invention relates to razors and more particularly to a razor of the type used for wet shaving.

It is an object of the invention to provide a razor apparatus which can be used with a water faucet to place the razor in fluid communication with the faucet.

Figure 1:
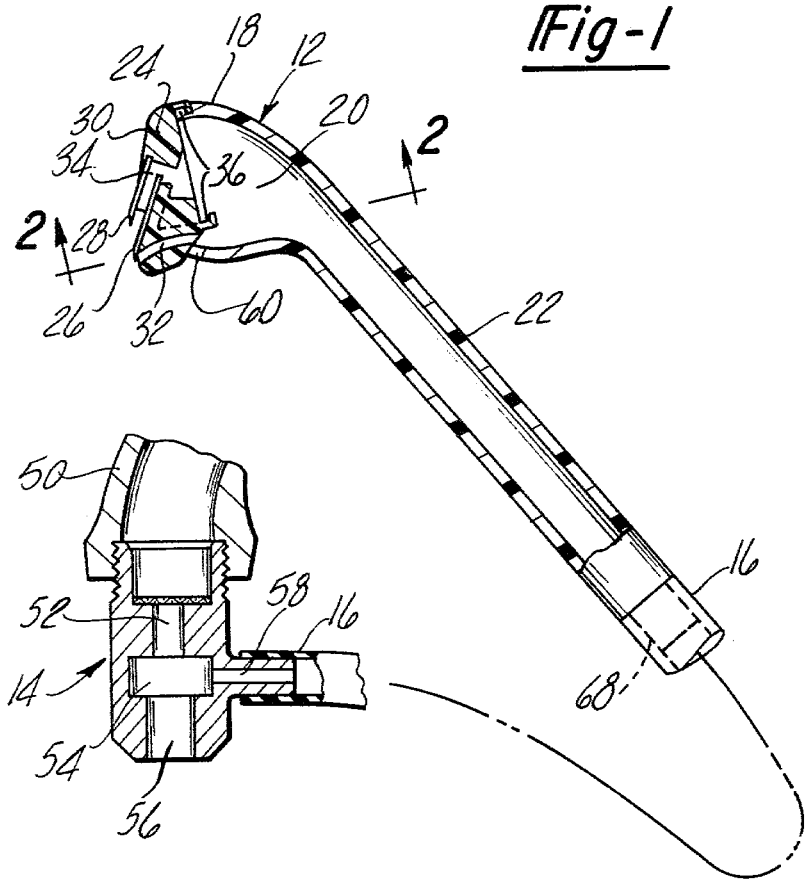
Figure 2:
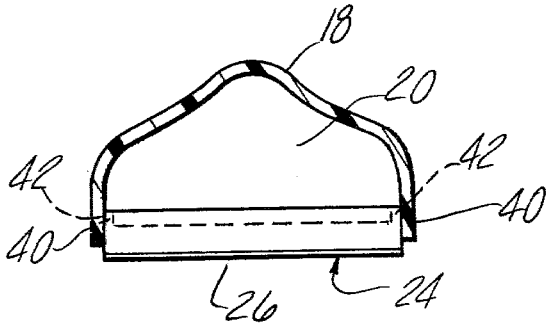

Still another object of the invention is to provide a razor in which a suction is created adjacent the cutting blades for the purpose of pulling the skin and whiskers into closer contact with the cutting edge of the razor blade and also to continuously suck out whiskers and soap lather from the face of the shaver. These and other objects of the invention will be apparent from the following description and from the drawings in which:

FIG. 1 is a cross sectional view of a razor assembly embodying the invention; and FIG. 2 is a cross sectional view taken on line 2—2 in FIG. 1.

The razor arangement embodying the invention is designated generally at 10 and includes a razor 12 and a venturi or aspirating apparatus 14 connected together by a tube 16.

The razor 12 has a head portion 18 which is hollow to form a cavity 20. The cavity 20 communicates with one end of a tubular handle 22 having its opposite ends connected to the flexible tube 16. The head 18 supports a razor blade assembly 24 of a conventional type. The blade assembly can be of the throw-away type formed integrally with the head 18 or it can be of the replaceable type as illustrated in the drawings. The razor blade assembly 24 has a pair of closely spaced blade elements 26 and 28 which extend parallel to each other and at an angle to the surface 30 which is adapted to be disposed substantially parallel and in contact with the surface to be shaved. A passage 32 is formed at the leading edge of the blade element 26 and communicates with the cavity 20 and the razor head 18. Similarly, a passage 34 is formed at the leading edge of the blade element 28 between the latter and the blade element 26 and communicates with the cavity 20.

The razor blade assembly 24 can be held detachably to the head portion 18 by end walls 40 of the head 18 which are sufficiently flexible to receive and press against the blade assembly 24. The walls 40 may be formed with tabs 42 which fit into grooves 36 formed on the blade assembly 24 for the purpose of receiving tongues of a conventional razor. The razor is made of plastic and has a resiliency which permits the end walls 40 to be flexed sufficiently to receive the tabs 42 thereby holding the blade in position with the perimeter of the head 18 in sealing engagement with the surface of the razor assembly 24.

The venturi or aspirating device 14 is adapted to be threadably connected to the outlet of a water faucet 50. The venturi 14 includes a restricted passage 52 which opens into a larger expansion passage 54 communicating with an outlet passage 56. The restricted passage 52, expansion passage 54 and outlet passage 56 are in axial alignment with each other and are disposed in a stream of water when the faucet is open. The expansion passage 54 communicates with a transversely extending suction port 58. During the flow of water through the alinged passages 52, 54, and 56, a suction is created at the port 58 which can be in excess of twenty-four inches of mercury during full flow of water from the faucet 50. The vacuum at the suction port 58 is communicated through the tube 16 to the cavity 20 and to the passages 32 and 34. Additionally, the head 18 is provided wth a plurality of uniformly spaced openings 60 adjacent to a surface of the razor blade assembly 24 which also communicate with the cavity 20 and are subjected to vacuum.

The tube 16 is of a sufficient length to permit free movement of the razor 12 during shaving and preferably is made of a transparent plastic material.

During the shaving operation, water is allowed to flow from the faucet and through the passages 52, 54 and 56 of the aspirating device 14 to create a vacuum pressure at the suction port 58. When the razor 12 is applied to a lathered beard, the suction tends to pull the skin of the shaver into closer contact with the blade elements 26 and 28 and at the same time serves to remove severed whiskers and lather without necessitating rinsing of the razor 12. The openings 60 at a forward portion of the razor tends to remove accumulated soap lather in the same manner. If desired, the razor 12 can be additionally cleaned by closing the outlet passage 56 with the finger causing the stream of water to be diverted from the expansion chamber 54 and through outlet 58 and the tube 16 to the razor 12 to flush the cutting edges 25 and 26 with water. Preferably, the razor 12 and tube 16 can be cleansed of accumulated whiskers and lather by submerging the head 18 of the razor 12 in water at the same time that water is allowed to flow through the device 14. This will cause water to be siphoned through the head 18 of the razor 18, through the hollow handle 22, through the tube 16 and to the outlet passage 56. Preferably the tube 16 is detachably connected to the suction port 58 so that the tube 16 together with the attached razor 12 may be removed for storage from the aspirating structure 14 leaving the structure 14 in position for conventional use of the faucet 50.

The tube 16 also is detachably connected to the handle 22 of razor 12 by way of a pressed fit between the internal bore of the end of tube 16 and a tubular extension 68 on the end of the handle 22. This makes it possible for the razor 12 to be used in the same manner as a conventional razor if it is so desired, by the easy and rapid removal of the tube 16 from the handle 22.

A razor for wet shaving has been provided in which a head member forms a chamber at one side of the razor blade assembly and the chamber communicates with openings forward of the cutting edge of the razor blade. The chamber in the head member is subjected to a suction created by an aspirating device connected to a faucet such that a vacuum is formed in the razor head when water runs in the faucet. The suction is effective to pull the skin and whiskers of the user into tighter conformation with the cutting edges of the blade and at the same time, severed whiskers and lather are removed to the stream of water flowing through the faucet and are flushed into a sink drain. Additionally, the head is formed with openings to receive lather accumulated forward of the head. The razor can be flushed with water either by dipping the razor in water and sucking water through the head to the aspirating device or the aspirating device can be momentarily plugged with the finger to cause water to be flushed through the razor in a reverse direction.

I claim:

1. A razor for wet shaving comprising; a head member, a razor blade assembly including a blade element having a cutting edge supported by said head member, said head member forming a chamber therein opposite said cutting edge and coextensive with the length of said cutting edge, passage means formed adjacent said blade assembly to one side and forward of the intended direction of movement of said cutting edge of said blade element, said passage means communicating with said chamber, aspirating means adapted to be connected to a source of flowing water to create a source of vacuum and permit the discharge of water, conduit means communicating the source of vacuum at said aspirating means with said chamber to establish vacuum pressure in said passage means to pull the skin of the shaver into close contact with said cutting edge of said blade element and transport whiskers and lather through said conduit means to said stream of water.

2. The combination of claim 1 wherein an elongated handle is connected to said head member, said elongated handle being hollow and having one end in communication with said chamber and the other end in communication with said conduit means.

3. The combination of claim 1 wherein said razor blade assembly includes a second cutting edge parallel and rearwardly of said first cutting edge, and additional passage means formed in said razor blade assembly between said cutting edges to communicate with said cavity.

4. The combination of claim 1 wherein said conduit means is a flexible tube having one end detachably connected to said aspirating means.

5. The combination of claim 1 wherein said aspirating means includes a suction port extending from said water passage and communicating therewith, said conduit means being operative to convey water from said passage means and chamber upon submerging said head member in water.

6. The combination of claim 1 wherein said aspirating means includes a port communicating with said source of flowing water, said conduit means being connected to said port and operative to convey water to said chamber and passage means upon closing of the water discharge end of said aspirating device.

7. The combination of claim 2 wherein said conduit means is detachably connected with said elongated handle.

8. The combination of claim 1 wherein said aspirating means includes a restricted passage communicating with an expansion passage and wherein said conduit means is connected to said expansion passage.

9. The combination of claim 2 wherein said conduit means is detachably connected to an end of said handle for communication with said chamber.

* * * * *